US006033016A

United States Patent [19]

Haywood

[11] Patent Number: 6,033,016

[45] Date of Patent: Mar. 7, 2000

[54] SEAT

[76] Inventor: Michael Haywood, Little Thatch Bushcombe Lane Woodmancote, Cheltenham GL52 4QL, United Kingdom

[21] Appl. No.: 09/180,859

[22] PCT Filed: May 13, 1997

[86] PCT No.: PCT/GB97/01277

§ 371 Date: Nov. 17, 1998

§ 102(e) Date: Nov. 17, 1998

[87] PCT Pub. No.: WO97/46146

PCT Pub. Date: Dec. 11, 1997

[30] Foreign Application Priority Data

Jun. 4, 1996 [GB] United Kingdom ..... 9611625

[51] Int. Cl.[7] ..... A47C 1/00

[52] U.S. Cl. ..... 297/195.11; 297/451.5

[58] Field of Search ..... 297/4, 195.11, 297/451.4, 451.5

[56] References Cited

U.S. PATENT DOCUMENTS

| | | | |
|---|---|---|---|
| 2,709,589 | 5/1955 | Zubler et al. | 297/4 |
| 4,138,156 | 2/1979 | Bonner | 297/4 |
| 4,641,882 | 2/1987 | Young | 297/195.11 |
| 4,676,547 | 6/1987 | Spillman | 297/4 |
| 4,892,352 | 1/1990 | Haywood | 297/195.11 |

*Primary Examiner*—Anthony D. Barfield
*Attorney, Agent, or Firm*—Young & Thompson

[57] ABSTRACT

A seat includes an elongate ground engageable support 11, an elongate stabilizer 12 pivotably connected at one end to one end of the support, a seat 10 secured relative to the stabilizer or the support adjacent to the one end thereof, and a lock for releasably locking the stabilizer in a first position in which it is substantially co-extensive with the support and in a second position in which it extends at an angle to the support and forward of the seat. The stabilizer includes, at a position removed from the seat, a leg abutment 20 for making contact with the front of a seated user's leg.

9 Claims, 4 Drawing Sheets

SEAT

BACKGROUND AND SUMMARY OF THE INVENTION

This invention relates to a seat and more particularly to a seat which is easily transportable.

Conventionally seats are in the form of chairs or stools having three or more legs for supporting a seating member in a stable seating position. Shooting sticks having a single elongate ground engageable support and a pair of outwardly foldable seating members at the upper end of the elongate support are also known, but these are neither particularly comfortable nor particularly stable.

It is also known from my British Patent Specification No. GB 2211725B to provide a seat formed as an integral plastics moulding and comprising a seating member, a ground engageable support depending from the seating member, the seating member alone being incapable of maintaining the seating member in a stable seating position, and a stabilizer. The stabilizer projects forwards of the seating member and includes, at a position removed from the seating member, a leg abutment for making contact with the front of a seated user's leg at or above the knee joint. This seat is more comfortable and stable than shooting sticks but suffers from the drawbacks that it is expensive to make and relatively difficult for a user to carry.

According to the present invention there is provided a seat comprising elongate ground engageable support means, elongate stabilizer means pivotably connected at one end to one end of the support means, a seating member secured relative to the stabilizer means or the support means at or adjacent to said one end thereof, and means for releasably locking the stabilizer means in a first position in which it is co-extensive or substantially co-extensive with the elongate support means and in a second position in which it extends at an angle to the support means and forwards of the seating member, the stabilizer means including, at a position removed from the seating member, leg abutment means for making contact with the front of a seated user's leg.

Preferably, the seating member is secured relative to the stabilizer means but it could be secured relative to the support means particularly if a slot is provided in the seating member for the stabilizer means to pass through.

Preferably, the stabilizer means is adapted to extend between a seated user's legs.

Preferably, the leg abutment means is adapted to make contact with the front of both legs of a seated user at or above the knee joints.

Preferably, the support means is pivotable and, to a limited extent, slidable relative to the stabilizer means and the releasable locking means, preferably, comprises sockets (or projections) on the stabilizer means, which sockets (or projections) can be selectively engaged by the support means.

Conveniently, the lower end of the support means is provided with a ground engageable spike covered by a removable cover having a non-slip base.

BRIEF DESCRIPTION OF THE DRAWINGS

The invention will now be more particularly described, by way of example, with reference to the accompanying drawings, in which.

DESCRIPTION OF THE PREFERRED EMBODIMENTS

Figures 1, 8:
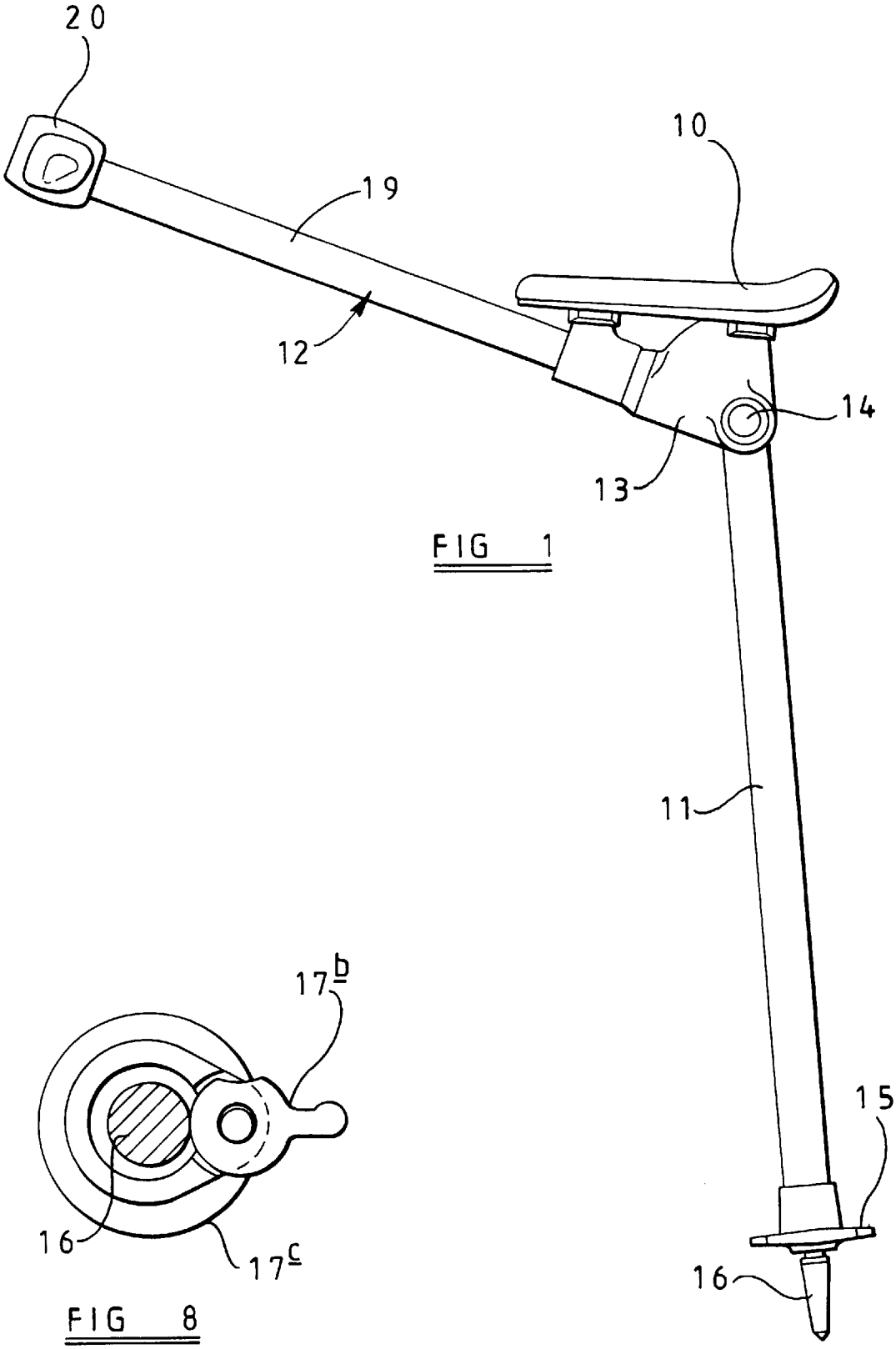
FIG. 1 is a side view showing one embodiment of a seat according to the present invention, in a first position.
FIG. 8 is a sectional view taken along the line VII—VII of FIG. 7.

Referring to the drawings, the seat shown therein comprises a seating member 10, a ground engageable support in the form of a single tubular leg 11, and a stabilizer 12.

The seating member 10 is in the form of a plastics moulding and is secured to a hollow bracket 13 at one end of the stabilizer 12.

The ground engageable support 11 is pivotally connected, at a position adjacent to its upper end, to the bracket 13 by a pivot pin 14.

Figure 7:
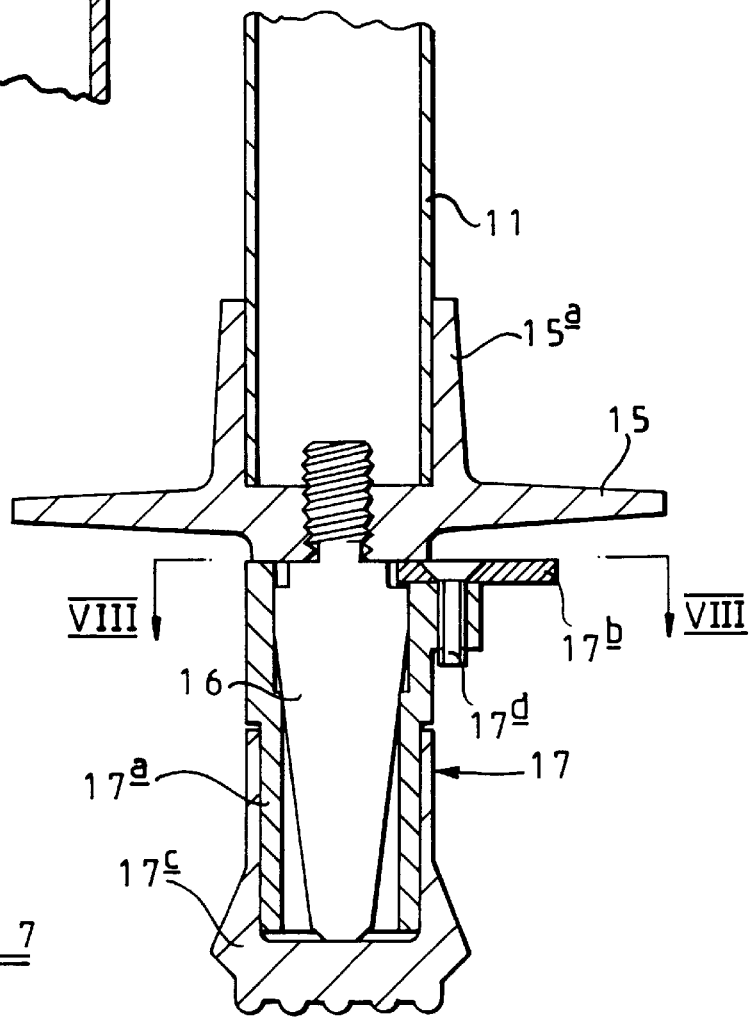
FIG. 7 is a fragmentary sectional view on an enlarged scale taken along the line VII—VII of FIG. 4 and showing a removable cover over the ground spike.

The tubular leg 11 is closed at its lower end by a ground engageable plate 15 having an upstanding skirt portion 15*a* which receives the lower end of the leg 11 as a tight push fit. A ground spike 16 is threadably engaged with the plate 15 to extend below the lower end of the leg 11 coaxially therewith. The ground spike 16 is covered by a removable cover 17 having a sleeve portion 17*a*, a pivotable locking lever 17*b* and a cap 17*c* of rubber or other non-slip material. The locking lever 17*b* is pivotable about a rivet 17*d* between the position shown in FIG. 7 in which it engages in an annular recess at the upper end of the ground spike 16 to lock the cover 17 on the ground spike 16 and a position in which it no longer engages in the annular recess so as to allow the cover 17 to be removed from the spike 16. A user can apply pressure with his/her feet to the ground plate 15 to press the spike 16 into soft ground when the cover 17 is removed from the spike 16.

The stabilizer 12 includes the bracket 13 and also comprises a single tubular member 19 and a cross-member 20 secured to the end of the tubular member 19 remote from the bracket 13.

The cross-member 20, which forms a leg abutment, extends to each side of the tubular member 19 by an equal distance and is contoured so as to be comfortable when pressed against the legs of a user.

Figure 2:
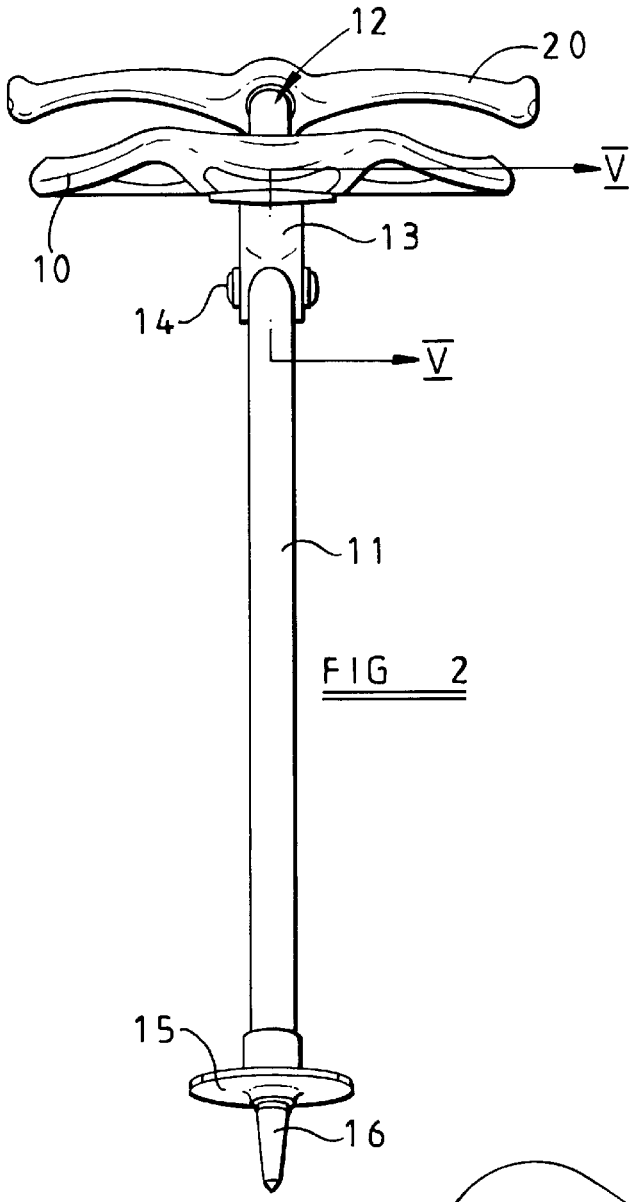
FIG. 2 is a rear view of the seat shown in FIG. 1.
Figure 3:
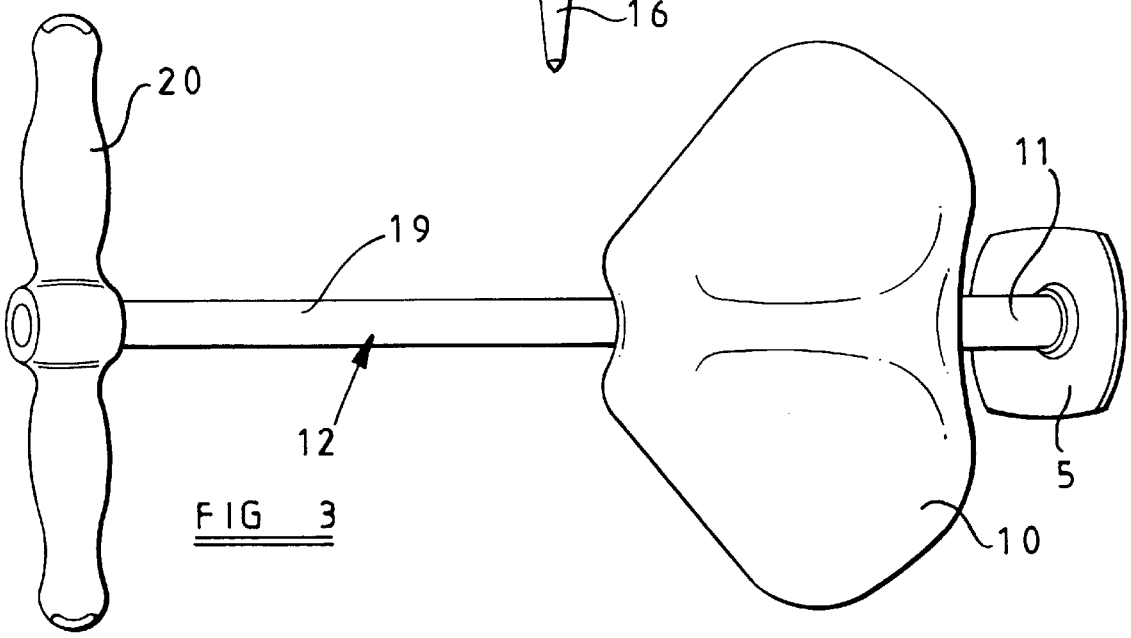
FIG. 3 is a plan view of the seat shown in FIG. 1.
Figure 4:
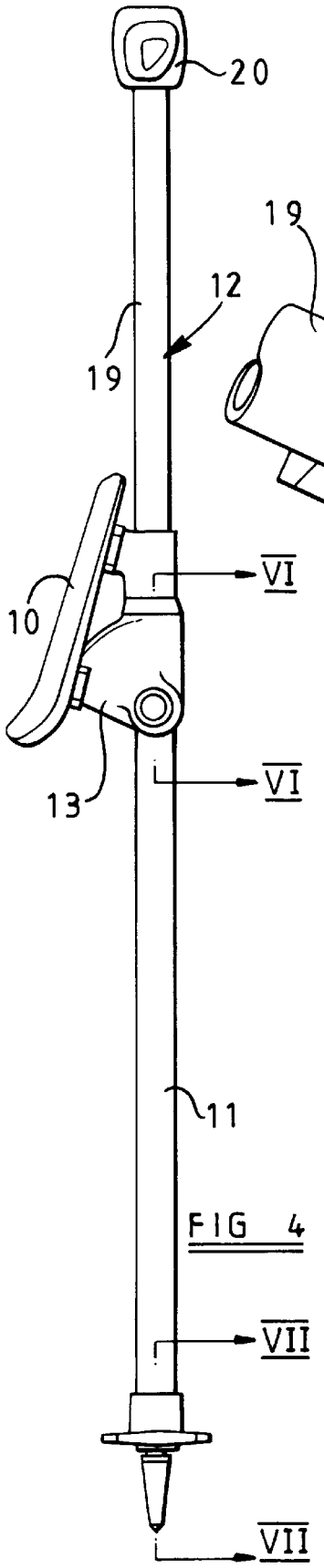
FIG. 4 is a side view of the seat shown in FIG. 1, in a second position.

Releasable locking means (to be described in more detail hereinafter) are provided between the upper end of the ground engageable support 11 and the bracket 13 to releasably lock the stabilizer 12 in a first position in which it is co-extensive or substantially co-extensive with the ground engageable support 11, as shown in FIG. 4, and in a second position in which it extends at an angle, typically an angle of about 115°, to the ground engageable support 11 and forwards of the seating member 10, as shown in FIGS. 1 to 3.

Figure 5:
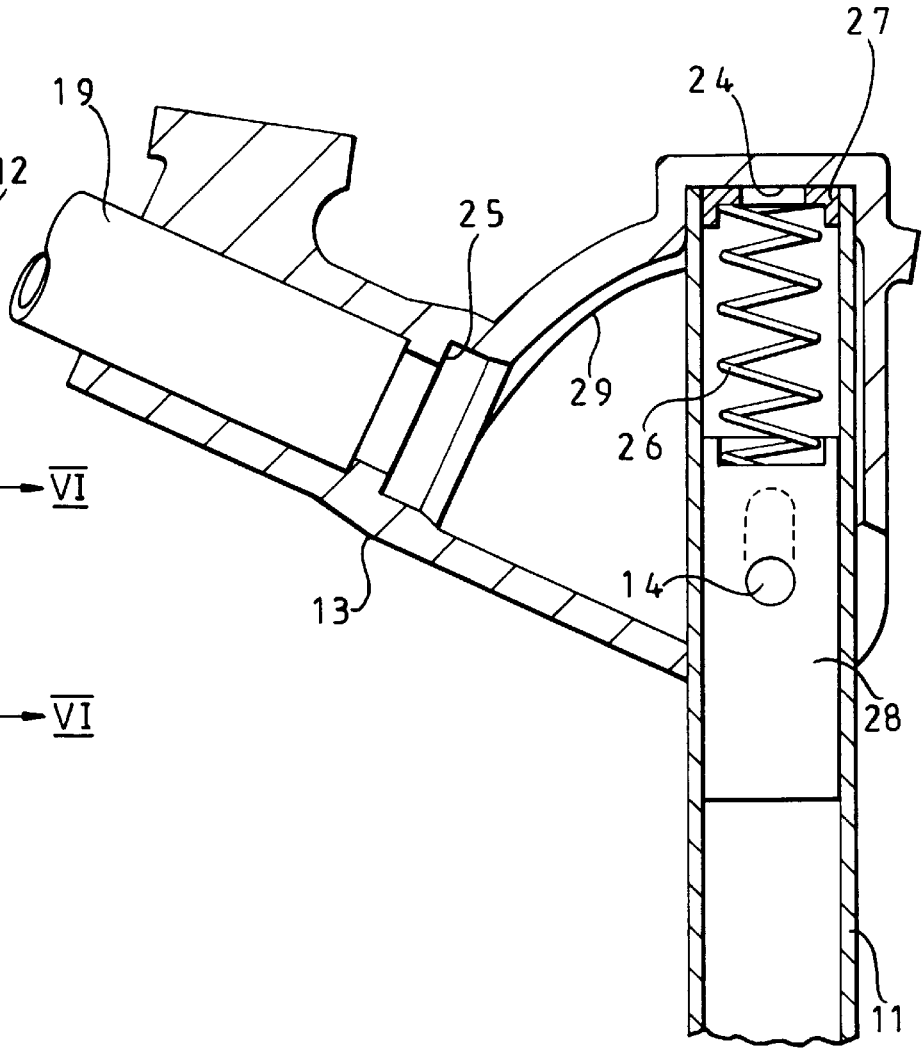
FIG. 5 is a fragmentary sectional view taken along line V—V of FIG. 2 showing one embodiment of the releasable locking means between the ground engageable support and the stabilizer on an enlarged scale.
Figure 6:
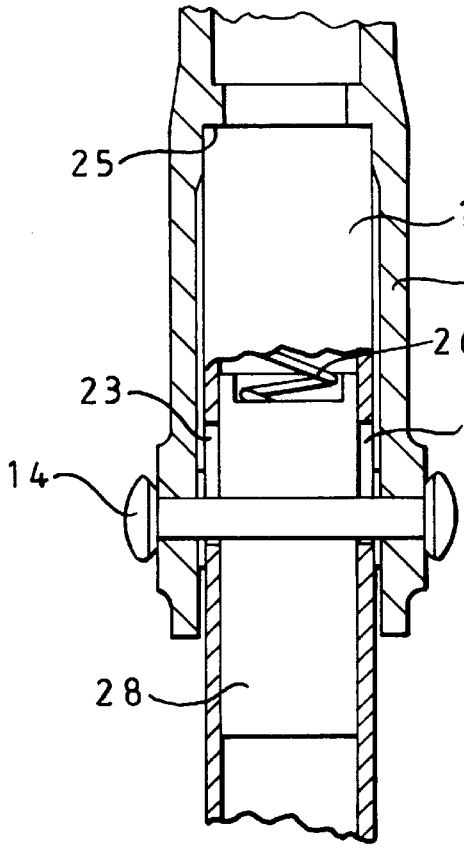
FIG. 6 is a fragmentary sectional view taken along line VI—VI of FIG. 4 also showing the releasable locking means between the ground engageable support and the stabilizer on an enlarged scale.

The releasable locking means between the support 11 and stabilizer 12 is shown in FIGS. 5 and 6.

The support 11 is pivotable and, to a limited extent, slidable relative to the bracket 13. This limited slidable movement is provided by two elongate slots 23 in the support 11 which slots receive the pivot pin 14 which is secured between opposite sides of the bracket 13. The upper end of the support 11 is engageable in one of two sockets 24 and 25 in the bracket 13 and is urged towards such an engaged position by a compression spring 26 acting between a spring seat 27 secured to the upper end of the support 11 and a pivot block 28 which is pivotable about the pivot pin 14 but which, unlike the support 11, is not slidable relative to the pivot pin 14. Thus, when the support 11 is pulled out of one of the sockets 24, 25 the spring 26 is compressed. A curved track 29 is provided between the two sockets 24 and 25 to guide the upper end of the support from one socket to the other. When the upper end of the support 11 reaches the other socket, the spring 26 urges the end of the support 11 into the other socket. The pivot block 28 also serves to spread side load over a length of the support tube 11.

It will be readily appreciated that the ground engageable support 11 is alone incapable of maintaining the seating member 10 in a stable seating position. However, in an operative position, a user is seated on the seating member 10 with the tubular member 19 extending between the user's legs and the cross-member 20 making contact with the front of the user's legs at or above the knee joints. To arrive at this position the user may start by holding the forward end of the stabilizer 12 in one hand with the support 11 to the rear in contact with the ground. The user would then pass one leg around the rear of the support 11 and move into a seated position coming into contact with the seating member 10 and at the same time lowering the cross-member 20 onto his/her legs at or just above the knee. The user's feet may then be positioned slightly apart and in a position affording most comfort. Once seated most of the user's weight is supported by the support 11 but the remaining weight is transferred to the user's legs to provide stability. To leave the seat, the user is able to take hold of the forward end of the stabilizer 12 and stand up.

When the seat is in its inoperative position, shown in FIG. 4, it takes the form of a walking stick and can be easily carried by a user. It can also be readily transformed into a seat, as shown in FIGS. 1 to 3, when required.

When the seat is in its operative position, shown in FIGS. 1 to 3, a table or tools (not shown) can be placed on or attached to the tubular member 19 or the cross-member 20.

The seat described above has a stabilizer which includes a single tubular member 19 which is adapted to extend between a user's legs. However, the stabilizer could be in the form of one or more tubular members which extend to one or both sides of a user's legs and which is/are provided with abutment means at positions removed from the seating member 10 for making contact with one or both of the user's legs.

Other modifications will be apparent to a person skilled in the art without departing from the scope of the invention. For example, the seating member 10 could be secured to the leg 11 instead of to the stabilizer 12. In this case, the seating member 10 will probably need to be provided with a slot in order for the stabilizer 12 to pass therethrough. Also, the leg 11 could be adjustable in length. In this case, the leg could comprise two telescopic members and means for releasably locking the two telescopic members in any one of a plurality of positions. Also, a wheel or ski could be connected to the lower end of the leg 11.

I claim:

1. A seat comprising elongate ground engageable support means (11), elongate stabilizer means (12) pivotably connected at one end to one end of the support means, a seating member (10) secured to at least one of the stabilizer means and the support means adjacent to said one end thereof, and means for releasably locking the stabilizer means in a first position in which it is substantially co-extensive with the elongate support means and in a second position in which it extends at an angle to the support means and forwards of the seating member, the stabilizer means including, at a position removed from the seating member, leg abutment means (20) for making contact with the front of a seated user's leg.

2. A seat as claimed in claim 1, wherein the seating member (10) is secured to the stabilizer means (12).

3. A seat as claimed in claim 1, wherein the stabilizer means (12) is adapted to extend between a seated user's legs.

4. A seat as claimed in claim 1, wherein the leg abutment means (20) is adapted to make contact with the front of both legs of a seated user at or above the knee joints.

5. A seat as claimed in claim 1, wherein the support means (11) is slidable relative to the stabilizer means (12).

6. A seat as claimed in claim 5, wherein the releasable locking means comprises two sockets (24,25) on the stabilizer means, which sockets can be selectively engaged by the support means (11).

7. A seat as claimed in claim 6, wherein the support means is urged by spring means (26) into engagement with one of the sockets.

8. A seat as claimed in claim 6, wherein a curved track (29) is provided to guide the support means between the two holders.

9. A seat as claimed in claim 1, wherein an end of the support means opposite the one end thereof is provided with a ground engageable spike (16) covered by a removable cover (17) having a non-slip base.

* * * * *